United States Patent [19]

Voltmer et al.

[11] Patent Number: 4,751,880

[45] Date of Patent: Jun. 21, 1988

[54] LABEL IMPRINTING MACHINE WITH CARTRIDGE INKING SYSTEM

[75] Inventors: Helmut Voltmer, Park Ridge; Michael Kavanagh, Saddle Brook; James C. Gulbach, Rutherford, all of N.J.

[73] Assignee: New Jersey Machine Inc., Fairfield, N.J.

[21] Appl. No.: 904,958

[22] Filed: Sep. 8, 1986

[51] Int. Cl.[4] ..... B41F 31/30; B41F 31/14

[52] U.S. Cl. ..... 101/348; 101/DIG. 14; 101/240; 101/330

[58] Field of Search ..... 101/DIG. 14, 348–350, 101/364, 328–330, 333, 235, 238–240

[56] References Cited

U.S. PATENT DOCUMENTS

| | | | |
|---|---|---|---|
| 1,077,408 | 11/1913 | Ielfield | 101/237 |
| 1,631,624 | 6/1927 | Conti et al. | 101/328 |
| 2,184,552 | 12/1939 | Hinsky | 101/DIG. 14 |
| 2,189,073 | 2/1940 | Levine | 101/DIG. 14 |
| 2,371,728 | 3/1945 | Andrews | 101/329 |
| 2,707,434 | 5/1955 | Morhardt | 101/DIG. 14 |
| 3,227,080 | 1/1966 | Hill | 101/330 |
| 4,022,124 | 5/1977 | Knudsen | 101/348 |
| 4,428,290 | 1/1984 | Junghans et al. | 101/348 |
| 4,597,329 | 7/1986 | Lembens | 101/350 |
| 4,655,131 | 4/1987 | Kramer | 101/236 |

*Primary Examiner*—William Pieprz

*Attorney, Agent, or Firm*—Charles E. Baxley

[57] ABSTRACT

A label imprinting machine has a feed hopper, a stacking hopper, an imprinting station, and a printing head at the imprinting station. Unimprinted labels are transported from the feed hopper to the imprinting station and imprinted labels from then to the stacking hopper. The machine further has a cartridge inking system including a holder for holding an ink cartridge, a pick up ring holding roll, an ink pick up ring on the pick up ring holding roll, an ink distribution roll in driving engagement with the pick up ring holding roll, and a power driven ink transfer roll engaging the printing head and frictionally engaging the ink distribution roll, to regulate the rotational speed of the ink distribution roll and the pick up ring holding roll. The ink distribution roll oscillates back and forth along its axis as it rotates about its axis.

9 Claims, 2 Drawing Sheets

LABEL IMPRINTING MACHINE WITH CARTRIDGE INKING SYSTEM

BACKGROUND OF THE INVENTION

This invention relates to a label imprinting machine with a cartridge inking system.

A known label imprinting machine prints designations, such as product expiration dates or encoded information on labels in any combinations of numbers and letters. It handles labels with dimensions from one inch by two inches (2.54 cm by 5.08 cm) up to a maximum of six inches by eight inches (15.2 cm by 20.3 cm). The labels may already have thereon other information that does not change.

The known machine includes a feed hopper, a stacking hopper, an imprinting station where labels are imprinted, means for transporting imprinted labels, one after the other, from the feed hopper to the imprinting station and for transporting imprinted labels from the imprinting station to the stacking hopper.

The known machine also has, at the imprinting station, a printing head or roll with a removable type holder that can be changed to bear the desired information to be imprinted on the labels.

The known machine further comprises an inking system including a metal ink distribution roll and a rubber ink roll tangential to the ink distribution roll. The ink roll is tangential to the face of the type on the printing head. Ink is applied from a bottle to the distribution roll and the ink roll, and the machine is run for a few cycles to distribute the ink evenly on the rolls. The labels are then fed to the imprinting station where ink is picked up by the printing head from the ink roll and applied to the labels.

The inking system of the known machine is subject to a number of disadvantages.

One such disadvantage of the known machine is that it is difficult to achieve and maintain uniformity of ink distribution on the various surfaces and ink delivery to the labels. If there is too much ink, the imprinted information tends to blur and furthermore tends to smear when the imprinted labels are stacked in the stacking hopper. If there is too little ink, the imprinted information tends to be too faint to be legible.

Another such disadvantage of the known machine is that the components of the inking system must often be disassembled and cleaned, resulting in excessive machine down time and increased cost of performing the imprinting function.

It is therefore an important object of the invention to modify the known machine by providing therein an improved and superior inking system that overcomes the disadvantages ennumerated above.

It is a further object to provide such an improved and superior inking system which is of simple construction and hence does not result in any substantial increase in the cost of the machine.

Other objects and advantages will appear hereinafter.

SUMMARY OF THE INVENTION

A label imprinting machine according to the invention has a feed hopper, a stacking hopper, an imprinting station, a printing head or roll at the imprinting station for imprinting the desired information on labels, and means for transporting unimprinted labels, one after the other, from the feed hopper to the imprinting station and for transporting imprinted labels from the imprinting station to the stacking hopper.

The machine further includes a cartridge inking system at the imprinting station and including an ink cartridge holder for holding an ink cartridge with an exposed ink surface, a pick up ring holding roll, a localized ink pick up ring protruding from the surface of the pick up ring holding roll, an ink distribution roll in driving engagement with the pick up ring holding roll, and a power driven ink transfer roll engaging the printing head or roll and frictionally engaging the ink distribution roll, frictionally to drive the latter, thus to regulate the rotational speed of the ink distribution roll and the pick up ring holding roll.

If too much ink gets into the system, the frictional engagement between the ink transfer roll and the ink distribution roll decreases and the speed of rotation of the ink distribution roll decreases, as does also the speed of rotation of the pick up ring holding roll, so that the ink pick up ring picks up less ink from the ink cartridge. If there is too little ink in the system, the frictional engagement referred to above increases and the speed of rotation of the ink distribution roll increases, as does also the speed of rotation of the pick up ring holding roll, so that the ink pick up ring picks up more ink from the ink cartridge. Thus, the amount of ink in the system is self-regulating.

In accordance with a further feature of the system, means are provided for oscillating the ink distribution roll back and forth along its axis as it rotates about its axis, so that the ink pick up ring delivers ink to the ink distribution roll substantially uniformly throughout all operative locations thereof.

DESCRIPTION OF THE INVENTION

Figure 1:
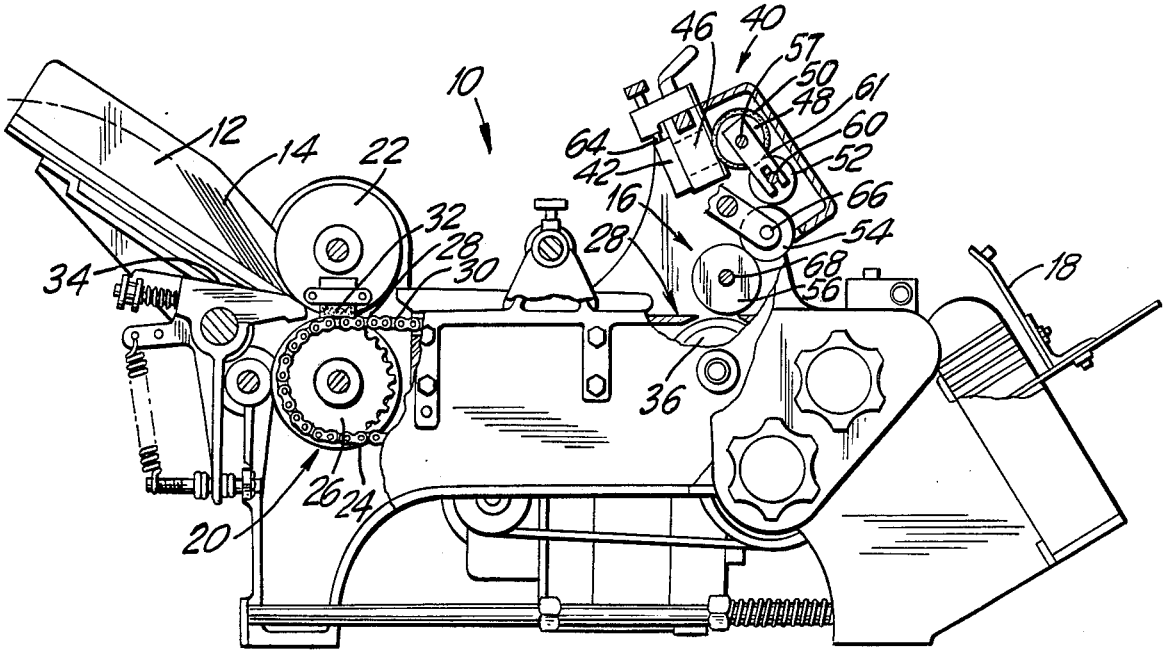
FIG. 1 is a side elevational view, partly broken away, of a label imprinting machine that is a preferred embodiment of the invention, the machine comprising a feed hopper, an imprinting station, a stacking hopper, and means for transporting unimprinted labels from the feed hopper to the imprinting station and imprinted labels from the printing station to the stacking hopper.

FIG. 1 shows a label imprinting machine, indicated generally at 10, comprising a feed hopper 12 in which unimprinted labels 14 are stacked, an imprinting station 16 that imprints designations, such as product expiration dates, on labels 14, a stacking hopper 18 for stacking imprinted labels 14, and conveyor means indicated generally at 20, for transporting unimprinted labels 14, one after the other, from feed hopper 12 to imprinting station 16 and for transporting imprinted labels 14, one after the other, from imprinting station 16 to stacking hopper 18, where they are stacked, one on top of another.

Conveyor means 20 includes a metal feed wheel 22 adjacent hopper 12, a feed chain 24, two gears, of which only gear 26 is visible, directly beneath feed wheel 22, a label guide track 28, feed chain lugs 30 (only one of which is shown), a piece of feed rubber 32 at the bottom of feed wheel 22 and a piece of retard rubber 34. Retard rubber 34 and feed wheel 22 form a bite which picks up labels 14, one at a time, from feed hopper 12. Labels 14 are thereupon picked up by feed rubber 32 and are placed on label guide track 28 and advanced therealong by feed chain lugs 30 which travel with feed chain 24, whereby labels 14 are delivered to imprinting station 16 in properly timed relationship. From thence, imprinted labels are transported along a continuation of track 28 and delivered to stacking hopper 18, it being noted that label guide track 28 is interrupted at imprinting station, and its place taken by a pressure roll 36.

Machine 10 further comprises an improved inking system, indicated generally at 40 in FIG. 1. System 40 embodies the present invention and is located at imprinting station 16.

Figure 3:
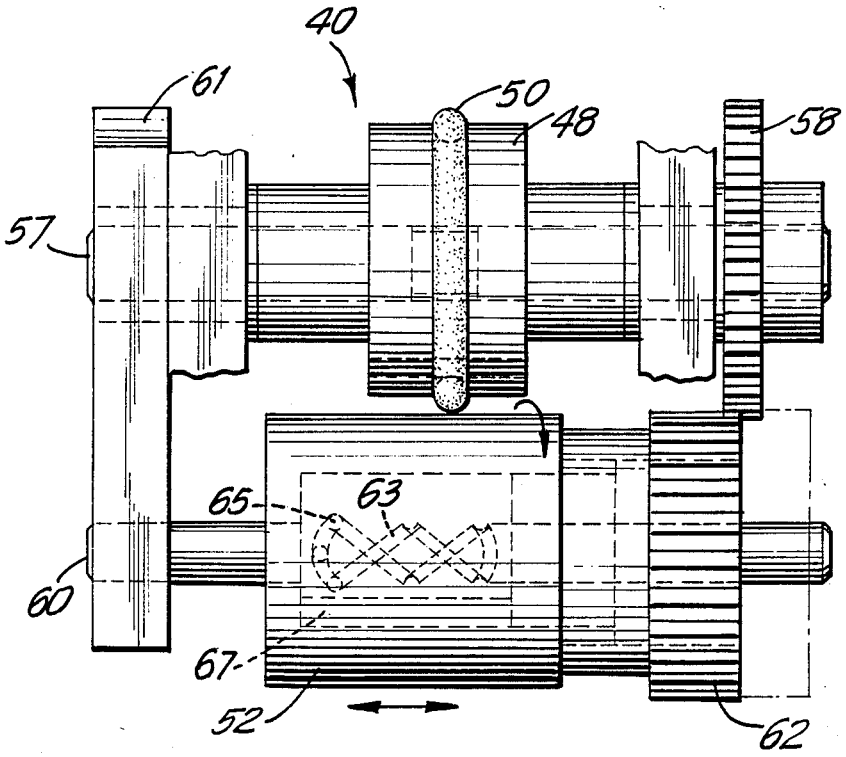
FIG. 3 is a fragmentary view taken on line 3—3 of FIG. 2.
Figure 2:
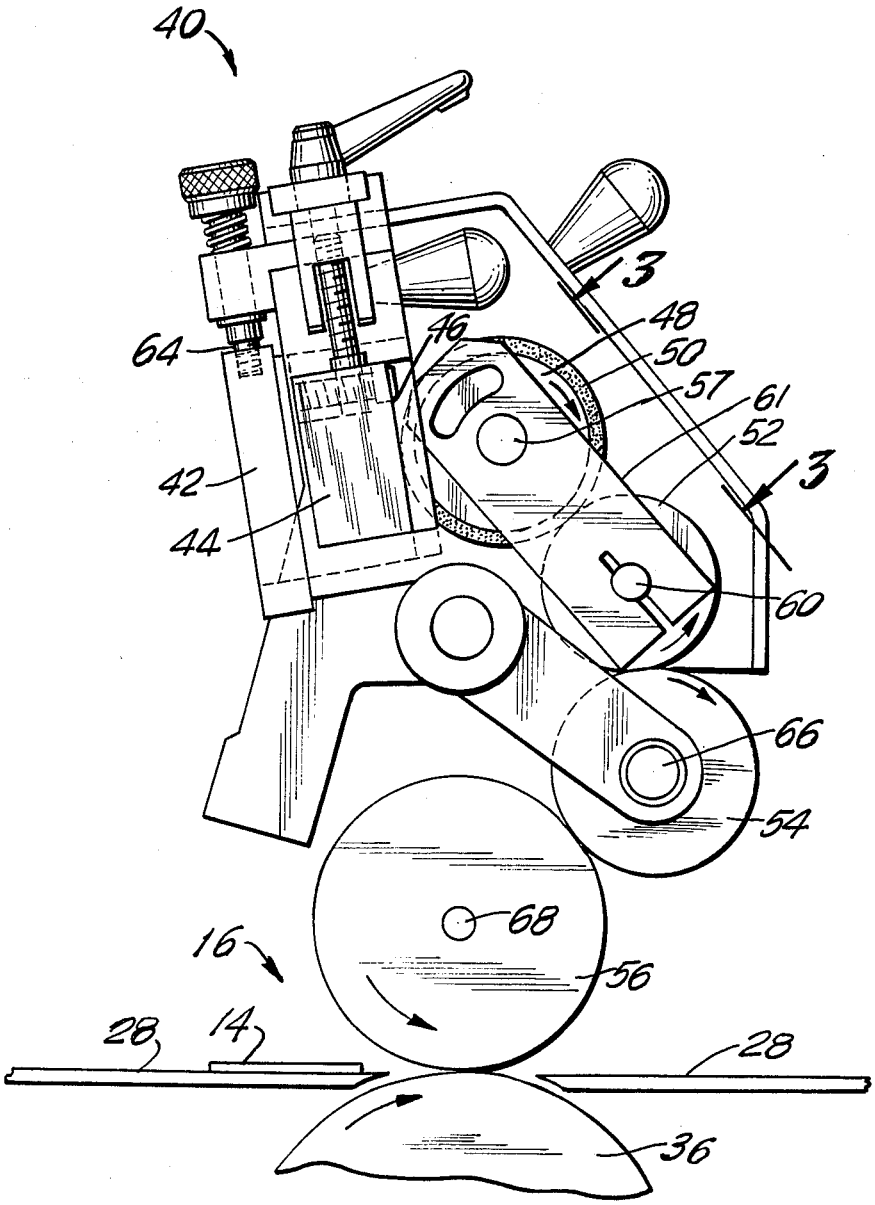
FIG. 2 is an enlarged fragmentary side elevational view of the imprinting station of the machine of FIG. 1.

As shown in FIGS. 2 and 3, system 40 comprises an ink holder 42 for holding an ink cartridge 44 having an exposed ink surface 46, a pick up ring holding roll 48 that holds on its surface and protruding a predetermined distance therefrom a replaceable rubber ink pick up ring 50, an ink distribution roll 52, an ink transfer roll 54 and a printing head or roll 56, which applies the imprinted legend to labels 14, as they are pressed against printing roll 56 by pressure roll 36 at imprinting station 16.

The surface of ink distribution roll 52 is spaced from the surface of pick up ring holding roll 48 a distance determined by the predetermined distance of protrusion of pick up ring 50 from the surface of roll 48, so that roll 52 obtains ink only from pick up ring 50.

Pick up ring holding roll 48 is mounted on a shaft 57 which also carries a gear 58, and ink distribution roll 52 is mounted on a special shaft 60 which also carries a gear 62 that meshes with gear 58.

Shaft 60 does not rotate. Instead, it is held stationary by clamping force imparted to it by an ink distribution roll support 61. Means are provided for oscillating ink distribution roll 52 back and forth along the axis of stationary shaft 60 as indicated by the double headed arrow in FIG. 3. The oscillating providing means is a ball reverser mechanism that is commercially available from Norco Inc. in six standard sizes, designated 1600, 1700, 1800, 1900, 2000 and 2001. The ball reverser mechanism includes grooves 63 on shaft 60, balls 65 that ride in grooves 63 and a housing 67 that retains balls 65 in grooves 63. Housing 67 is fastened in roll 52, to which gear 62 is also fastened. The friction force between the periphery of ink transfer roll 54 and the periphery of roll 52 rotates roll 52 in the direction of the arrow shown on roll 52 in FIG. 2. The rotation of roll 52 is transmitted via gear 62 and gear 58 to shaft 57 and hence to pick up ring holding roll 48. The rotational motion of roll 52 around stationary shaft 60 causes an oscillation motion of roll 52 along the axis of shaft 60 as indicated by the double headed arrow in FIG. 3 through the action of balls 65 in grooves 63 of shaft 60. During its complete oscillating cycle gear 58 and gear 62 are always in engagement. Roll 52 is shown in FIG. 3 at the leftmost extreme of its oscillation, with gear 62 still engaging gear 58.

System 40 further comprises means for adjusting the position of holder 42 relative to ink pick up ring 50, to determine and control the amount of ink picked up by pick up ring 50. As shown, this means is an eccentric adjustment screw 64.

Ink transfer roll 54 is mounted on a shaft 66, which is power driven in the direction of the arrow on roll 54 in FIG. 2, while printing roll 56 is mounted on a shaft 68 and is driven in the direction of the arrow on roll 56 in FIG. 2.

Ink transfer roll 54 frictionally drives ink distribution roll 52, which as aforesaid drives pick up ring holding roll 48.

All shafts are parallel to each other and exposed ink surface 46 of cartridge 44 is held parallel to shaft 57.

In operation, ink cartridge 44 is inserted in ink cartridge holder 42, and the machine is started. Ink is picked up continuously by ink pick up ring 50 from surface 46 during rotation of pick up ring holding roll 48, in an amount determined by the setting of eccentric adjustment screw 64. Ink distribution roll 52 oscillates back and forth along its axis while it rotates, and if it gets saturated with ink, because ink distribution roll 52 is frictionally driven, it slows down until the excess ink is used up. This using up of excess ink creates more friction which in turn speeds up the rotation of ink distribution roll 52. The oscillation of roll 52 has the result that pick up ring 50 delivers ink to ink distribution roll 52 substantially uniformly throughout all operative locations thereof.

In net result, inking system 40 uses ink more efficiently and uniformly than does the inking system of the known machine and achieves the above stated objects and advantages among others.

The disclosed details are exemplary only and are not to be taken as limitations on the invention except as those details may be included in the appended claims.

What is claimed is:

1. In a label imprinting machine for printing designations on labels, the machine including a feed hopper, a stacking hopper, an imprinting station, means for transporting unimprinted labels from said feed hopper to the imprinting station and imprinted labels from the imprinting station to the stacking hopper, and a printing roll at the imprinting station, the improvement comprising a cartridge inking system including an ink cartridge holder for holding an ink cartridge with an exposed ink surface, a pick up ring holding roll, an ink pick up ring on said pick up ring holding roll, an ink distribution roll in driving engagement with said pick up ring holding roll, a power driven ink transfer roll engaging said printing roll and frictionally engaging said ink distribution roll, frictionally to drive the latter, and means for oscillating said ink distribution roll back and forth along its axis as it rotates about its axis.

2. The machine of claim 1 wherein said oscillating means is a ball reversing mechanism.

3. The machine of claim 1 wherein the improvement further comprises means for adjusting the position of said ink cartridge holder relativce to said ink pick up ring, to determine and control the amount of ink picked up thereby.

4. The machine of claim 3 wherein said adjusting means is an eccentric adjustment screw.

5. The machine of claim 1 wherein said ink pick up ring is a single ring localized axially of said pick up ring holding roll.

6. The machine of claim 5 wherein said ink pick up ring protrudes a predetermined distance from the surface of said pick up ring holding roll, and the surface of said pick up ring holding roll is spaced from the surface of said ink distribution roll a distance determined by the predetermined distance, so that said ink distribution roll obtains ink only from said pick up ring.

7. The machine of claim 6 wherein said pick up ring is replaceable.

8. In a label imprinting machine for printing designations on labels, the machine including a feed hopper, a stacking hopper, an imprinting station, means for transporting unimprinted labels from said feed hopper to the imprinting station and imprinted labels from the imprinting station to the stacking hopper, and a printing roll at the imprinting station, the improvement comprising a cartridge inking system including an ink cartridge holder for holding an ink cartridge with an exposed ink surface, a pick up ring holding roll, a single nonmetallic ink pick up ring on said pick up ring holding roll and localized axially of said pick up ring holding roll, an ink distribution roll in driving engagement with said pick up ring holding roll, a power driven ink transfer roll engaging said printing roll and frictionally engaging said ink distribution roll, frictionally to drive the latter, means for adjusting the position of said ink cartridge holder relative to said ink pick up ring, to determine and control the amount of ink picked up thereby, and means for oscillating said ink distribution roll back and forth along its axis as it rotates about its axis.

9. The machine of claim 8 wherein said ink pick up ring is made of rubber and protrudes a predetermined distance from the surface of said pick up ring holding roll, and the surface of said pick up ring holding roll is spaced from the surface of said ink distribution roll a distance determined by the predetermined distance, so that said ink distribution roll obtains ink only from said pick up ring.

* * * * *